US007548031B2

(12) United States Patent
Ichikawa et al.

(10) Patent No.: US 7,548,031 B2
(45) Date of Patent: Jun. 16, 2009

(54) LIGHTING APPARATUS FOR DISCHARGE LAMP

(75) Inventors: Tomoyuki Ichikawa, Shizuoka (JP); Takuya Serita, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 307 days.

(21) Appl. No.: 11/181,862

(22) Filed: Jul. 15, 2005

(65) Prior Publication Data

US 2006/0012318 A1 Jan. 19, 2006

(30) Foreign Application Priority Data

Jul. 16, 2004 (JP) ..... P.2004-209751

(51) Int. Cl.
*H05B 39/04* (2006.01)
*H05B 37/02* (2006.01)
*H05B 41/00* (2006.01)

(52) U.S. Cl. ..... 315/308; 315/209 T; 315/360

(58) Field of Classification Search ..... 315/209 R, 315/209 T, 225, 226, 246, 247, 291, 307, 315/308, 360
See application file for complete search history.

(56) References Cited

U.S. PATENT DOCUMENTS 5,465,029 A * 11/1995 Hanazaki et al. ..... 315/308
5,485,061 A * 1/1996 Ukita et al. ..... 315/307
5,486,740 A * 1/1996 Yamashita et al. ..... 315/308
5,491,387 A * 2/1996 Saito ..... 315/307
5,572,094 A 11/1996 Yamashita et al. ..... 315/308
5,828,177 A * 10/1998 Toda et al. ..... 315/127
6,153,987 A * 11/2000 Toda et al. ..... 315/308
6,362,577 B1 3/2002 Ito et al. ..... 315/289
6,489,730 B2 * 12/2002 Ito et al. ..... 315/219
6,791,273 B2 * 9/2004 Ito et al. ..... 315/82
6,850,015 B2 * 2/2005 Ishizuka et al. ..... 315/224
6,960,886 B2 * 11/2005 Ishizuka ..... 315/80
2003/0209993 A1 * 11/2003 Ito et al. ..... 315/209 R
2003/0214251 A1 * 11/2003 Ichikawa et al. ..... 315/224
2003/0222599 A1 * 12/2003 Ito et al. ..... 315/291
2004/0246750 A1 * 12/2004 Ichikawa et al. ..... 363/21.12
2006/0028152 A1 * 2/2006 Ichikawa ..... 315/291

FOREIGN PATENT DOCUMENTS

JP 762 809 A3 10/1999
JP 2003-338390 A 11/2003
JP 2003-338393 A 11/2003
JP 1 345 479 A3 6/2004

* cited by examiner

*Primary Examiner*—Douglas W Owens
*Assistant Examiner*—Minh D A
(74) *Attorney, Agent, or Firm*—Sughrue Mion, PLLC

(57) ABSTRACT

In the transient electric power control of a discharge lamp containing no mercury or a small amount of mercury, a change value relating to a lamp voltage from the initial value thereof is detected. A control unit is provided to change the temporal change rate of electric power supplied to the discharge lamp during the transient time period in accordance with the increase of the change value or the time lapse.

9 Claims, 9 Drawing Sheets

LIGHTING APPARATUS FOR DISCHARGE LAMP

The present invention claims foreign priority, based on Japanese patent application no. JP2004-209751, filed on Jul. 16, 2004, the contents of which is incorporated herein by reference in its entirety. This priority claim is being made concurrently with the filing of this application.

BACKGROUND

1. Technical Field

The present invention relates to a technique of realizing suppression of the variation of optical output and suppression of radiation noise in the transient power control of a discharge lamp that contains a small amount of mercury or no mercury.

2. Related Art

In the case of using a discharge lamp for a lamp of an automobile, the light intensity must be quickly increased after starting the lighting of the discharge lamp. Accordingly, transient power control is performed such that, immediately after the lighting, an electric power larger than the steady lighting state power is supplied to the discharge lamp. Then, the electric power applied to the discharge lamp is reduced gradually with the lapse of time.

In one type of discharge lamp, a small amount of mercury is sealed. In an environmentally friendly type of discharge lamp, there is no mercury (a so-called mercury-free type). In the latter type, transient power control is executed in view of the variance of the lamp voltage at the initial stage of the lighting, the variance of the rising characteristics of light beam at the time of the lighting, etc.

For example, in one related art structure a lamp voltage (or a signal voltage corresponding to the lamp voltage) of the discharge lamp immediately after the lighting is detected and stored as an initial value. Then, a change value of the lamp voltage (voltage difference) with reference to the initial value is calculated and an electric power supplied to the discharge lamp is controlled based on the change value (see Japanese patent publication JP-A-2003-338390).

In the discharge lamp containing mercury, during a time period from the start of the lighting to the steady lighting, since the change value of the lamp voltage is large and the degree of the correlation between the lamp voltage and the optical output is high, there is employed a method in which the lamp voltage is detected to control the electric power supplied to the lamp.

In contrast, in the discharge lamp of mercury-free type, since the change value of the lamp voltage is small during a time period from the start of the lighting to the steady lighting, it is difficult to obtain a correlation between the lamp voltage and the optical output. Thus, it is necessary to use a control method different from the transient power control method. For example, the following method is proposed when a discharge lamp with a rated power of 35 W is used.

(1) A constant electric power of 75 W is applied to the lamp at the time of starting the lighting.

(2) Where the change value of the lamp voltage with reference to the lamp voltage (initial value) just after lighting is represented as "ΔVL", when ΔVL reaches a threshold value (ΔVL1), the electric power supplied to the lamp is reduced to a value determined according to ΔVL.

(3) When ΔVL further increases to reach another threshold value (ΔVL2), a timer control is started to reduce the electric power supplied to the lamp gradually with the time lapse to converge to 35 W. Incidentally, as the timer control, the electric power supplied to the lamp is reduced gradually with the increase of the voltage at a capacitor by using an integration circuit constituted by the capacitor and a resistor.

FIG. 8 illustrates the temporal changes of the electric power "Pw" supplied to the lamp, the lamp voltage "VL" and the terminal voltage "Vc" of a capacitor for the timer control in the case of starting the lighting of the discharge lamp from a state where a luminous tube thereof is cooled (a so-called cold start). The meanings of time points t1, t2, t3, t4 and a time period Tn are as follows.

t1 represents a time point where ΔVL reaches ΔVL1.

t2 represents a time point where ΔVL reaches ΔVL2.

t3 represents a time point where noise generation starts.

t4 represents a time point where noise generation terminates.

Tn means a time period during which noise is generated (t3 to t4).

In this example, the initial value of the lamp voltage is 25 volts, and the electric power supplied to the lamp is set to 75 W when ΔVL increases with the lapse of time and the time reaches the time point t1. When the time reaches t1, the electric power supplied to the lamp is reduced in accordance with ΔVL. Then, when the time reaches the time point t2, the timer control starts. That is, the charging of the capacitor for the timer control is started and Vc increases gradually. The electric power supplied to the lamp is reduced gradually in a reverse phase relation with the increasing curve of Vc and finally converges to 35 W (in this example, the saturation value of the lamp voltage is 45 volt).

In the noise generation period Tn started from the time point t3 (for example, 10 to 20 seconds after the starting of the lighting), a state of the discharge lamp is unstable and so there arise a problem that electromagnetic noise is radiated during this time period.

In the related art circuit configuration, there is a problem in that it is difficult to obtain good rising characteristics of the optical output and to suppress the influence of the electromagnetic noise.

In the discharge lamp containing mercury, one of actions of mercury is that the temperature increase of the luminous tube is promoted so that light can be emitted even in a cooled state of the luminous tube. That is, in the discharge lamp of mercury-free type, since the action of the mercury is not exerted, it is required to increase the electric power applied to the discharge lamp thereby to increase the temperature of the luminous tube.

To this end, the discharge lamp of mercury-free type is designed so that the luminous tube has a large thickness so as to be durable with an excessive electric power applied thereto.

Thus, the transient power control for the discharge lamp of mercury-free type requires a long time period from the start of the lighting to the stable state of the discharge as compared with the discharge lamp containing mercury. As a result, when the electromagnetic noise generated during this time period is radio noise, the noise may adversely influence various kinds of electronic devices such as a radio or television.

As a method of suppressing the generation of the electromagnetic noise during the noise generation period Tn, it has been experimentally proven that a method of supplying more electric power to the discharge lamp is effective. However, in the case of increasing the electric power applied to the discharge lamp to a degree capable of suppressing the noise, there arises a problem that a large amount of overshoot arises in the rising characteristics of the optical output, or the degradation of the luminous tube is accelerated.

FIG. 9 is a graphical diagram which exemplarily shows the temporal changes of the optical output "L", the applied electric power "Pw" and the terminal voltage "Vc" in the cold start. This figure shows the time constant of the integration circuit including the capacitor for the timer control.

In this case, the increase of Vc becomes gentle and the noise is suppressed by relatively increasing the electric power applied to the discharge lamp during the time period Tn. However, since the electric power applied to the discharge lamp becomes excessive, an amount of the overshoot ("Ov" exaggeratively shown in the figure) of the optical output becomes large.

In this manner, in the related art technique, there is a problem in that it is difficult to realize both the suppression of the noise and the improvement of the rising characteristics of the optical output or that the control and the circuit configuration for realizing it.

SUMMARY

An object of the invention is to realize the optimum rising characteristics of the optical output of a discharge lamp while suppressing the generation of noise in a lighting apparatus for the discharge lamp which does not contain any mercury or contains a small amount of mercury. However, the present invention may have other objects, or no objects at all without departing from its scope.

To attain the aforesaid object, in the lighting apparatus for a discharge lamp which gradually reduces electric power supplied to the discharge lamp in accordance with time lapse during a transient time period where the discharge lamp containing no mercury or a small amount of mercury reaches a stable lighting state, the apparatus includes the following constituent elements.

The apparatus includes a voltage difference detection means which detects a change value of a lamp voltage from an initial value of the lamp voltage; and an electric power control means which changes, from a time point where the change value detected by the voltage difference detection means reaches a predetermined threshold value or more, a temporal change rate of an electric power supplied to the discharge lamp during the transient time period in accordance with an increase of the change value or a time lapse.

Thus, according to the invention, from the time point where the change value of the lamp voltage reaches the predetermined threshold value or more, the temporal change rate of the electric power supplied to the discharge lamp is not defined uniformly but changed in accordance with the increase of the change value of the lamp voltage or the time lapse, whereby the transient power control taking into consideration of the suppression of the radiation noise and the suppression of the change of the optical output can be realized.

According to the invention, during the transient time period where the discharge lamp reaches the stable lighting state, the electric power control can be performed so as to suppress the radiation noise from a luminous tube and also not to cause a remarkable amount of overshoot as to the rising characteristics of the optical output for the suppression of the noise.

To simplify of the circuit configuration and the controllability, the temporal change rate of the electric power supplied to the discharge lamp can be changed stepwise from a negative value to zero by utilizing the time constant circuit using the capacitor and a resistor. That is, the time constant circuit operates at the time point where the voltage change value relating to the lamp voltage from the initial value thereof is detected to reach at least the threshold value, and the charge time constant of the capacitor is switched in accordance with the increase of the voltage change value or the increase of the voltage of the capacitor thereby to converge the electric power to a rated electric power while switching the temporal change rate of the electric power during the transient time period.

For example, in the configuration where the time constant circuit includes a capacitor and a plurality of resistors, the electric power during the transient time period is controlled in accordance with a first time constant at the time point where the voltage change value relating to the lamp voltage from the initial value thereof is detected to reach at least the threshold value or more, thereby suppressing the noise. Thereafter the electric power during the transient time period is controlled in accordance with a second time constant smaller than the first time constant. According to this configuration, the switching of the time constant is required to be only two steps and so the simple circuit configuration can be realized (it becomes difficult to obtain the condition for the switching timing etc. in the case of three or more stages).

DETAILED DESCRIPTION

Figure 1:
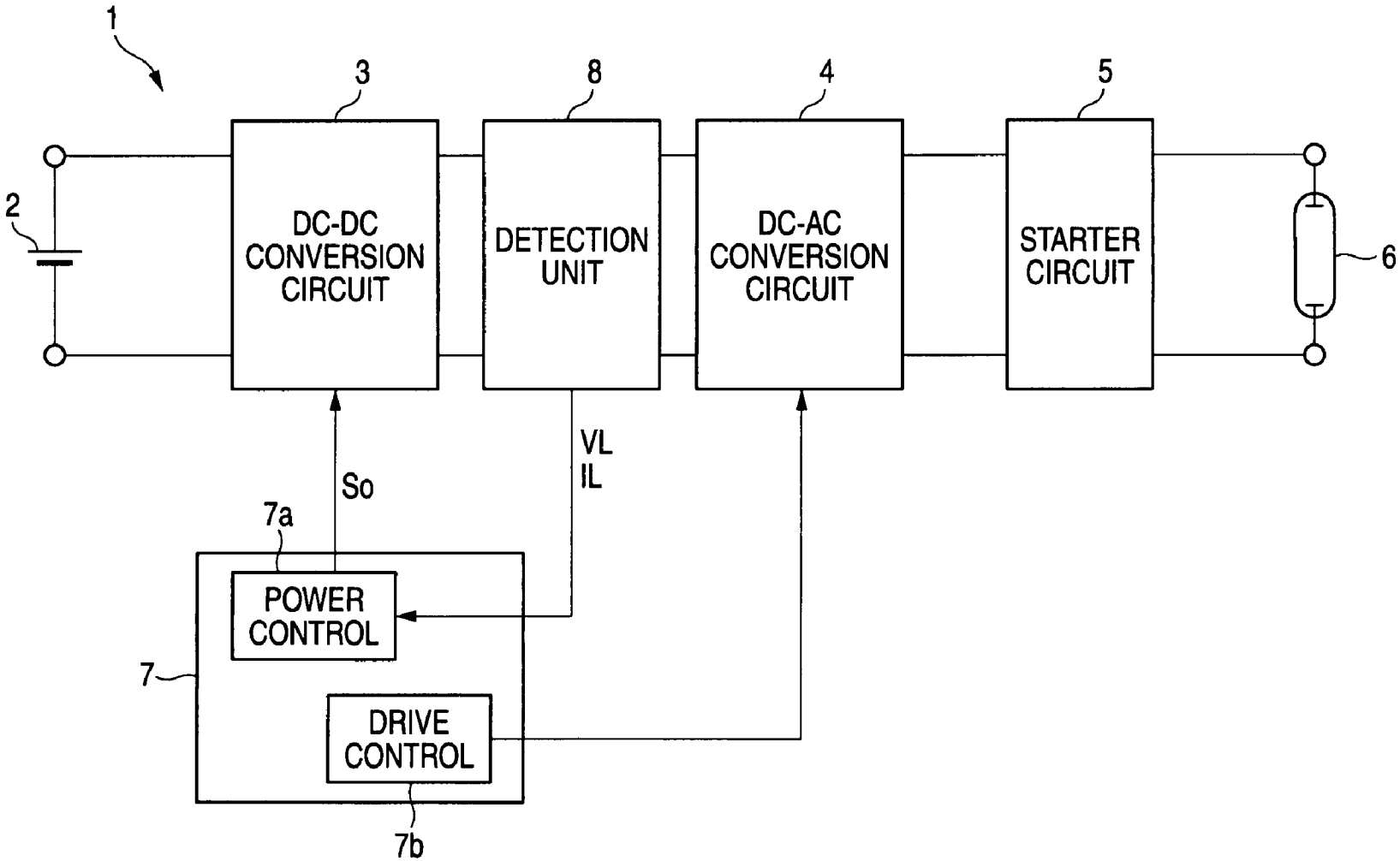
FIG. 1 illustrates a diagram showing an exemplary, non-limiting basic configuration.

FIG. 1 is a diagram showing an exemplary, non-limiting configuration of the discharge lamp lighting apparatus 1. The discharge lamp lighting apparatus includes a DC power supply 2, a DC-DC conversion circuit 3, a DC-AC conversion circuit 4, a starting circuit (a so-called starter) 5, a discharge lamp 6 and a control circuit 7.

The DC-DC conversion circuit 3 acts to receive a DC input voltage from the DC power supply 2 and convert the input voltage into a desired DC voltage. For example, but not by way of limitation, a flyback-type DC-DC converter is used as the DC-DC conversion circuit.

The DC-AC conversion circuit 4 is provided to convert the output voltage of the DC-DC conversion circuit 3 into an AC voltage and supply the AC voltage to the discharge lamp 6. For example, but not by way of limitation, when the DC-AC conversion circuit is configured by an H-bridge type (or full-bridge type) circuit, two arms are formed by four semiconductor switching elements, driving circuits for separately driving the switching elements of the two arms are provided, and two pairs of switching elements are turned on and off alternatively in an opposite manner based on a signal from a drive control unit 7*b* constituting the control circuit 7 thereby to output the AC voltage.

The starter circuit 5 is provided to generate a high voltage pulse signal (starting pulse) for the discharge lamp 6 thereby to start the discharge lamp. That is, the starting pulse is superimposed with the AC voltage outputted from the DC-AC conversion circuit 4 and then applied to the discharge lamp 6. Incidentally, a discharge lamp of mercury-free type or a discharge lamp having a reduced amount of mercury is the discharge lamp 6.

The control circuit 7 receives a detection signal representing the lamp voltage of the discharge lamp 6 and a current flowing through the discharge lamp, or a voltage corresponding to the lamp voltage and a current corresponding to the current flowing through the discharge lamp thereby to control electric power supplied to the discharge lamp 6. That is, a power control unit 7*a* in the control circuit 7 controls the supplied electric power in accordance with the state of the discharge lamp 6. For example, but not by way of limitation, the power control unit receives the detection signal (referred to as voltage detection signal "VL" and as current detection signal "IL") from a detection unit 8 which detects the output voltage and the output current of the DC-DC conversion circuit 3, and the control circuit 7 outputs a control signal (hereinafter referred to "So") to the DC-DC conversion circuit 3 to control the output voltage of the DC-DC conversion circuit.

The power control unit 7*a* controls electric power in a transient time period until the discharge lamp 6 reaches a stable lighting state, and also controls electric power in a stable state of the discharge lamp. For example but not by way of limitation, the pulse width modulation (PWM) method and the pulse frequency modulation (PFM) method are known in the art as the switching control methods of the power control unit.

Figure 2:
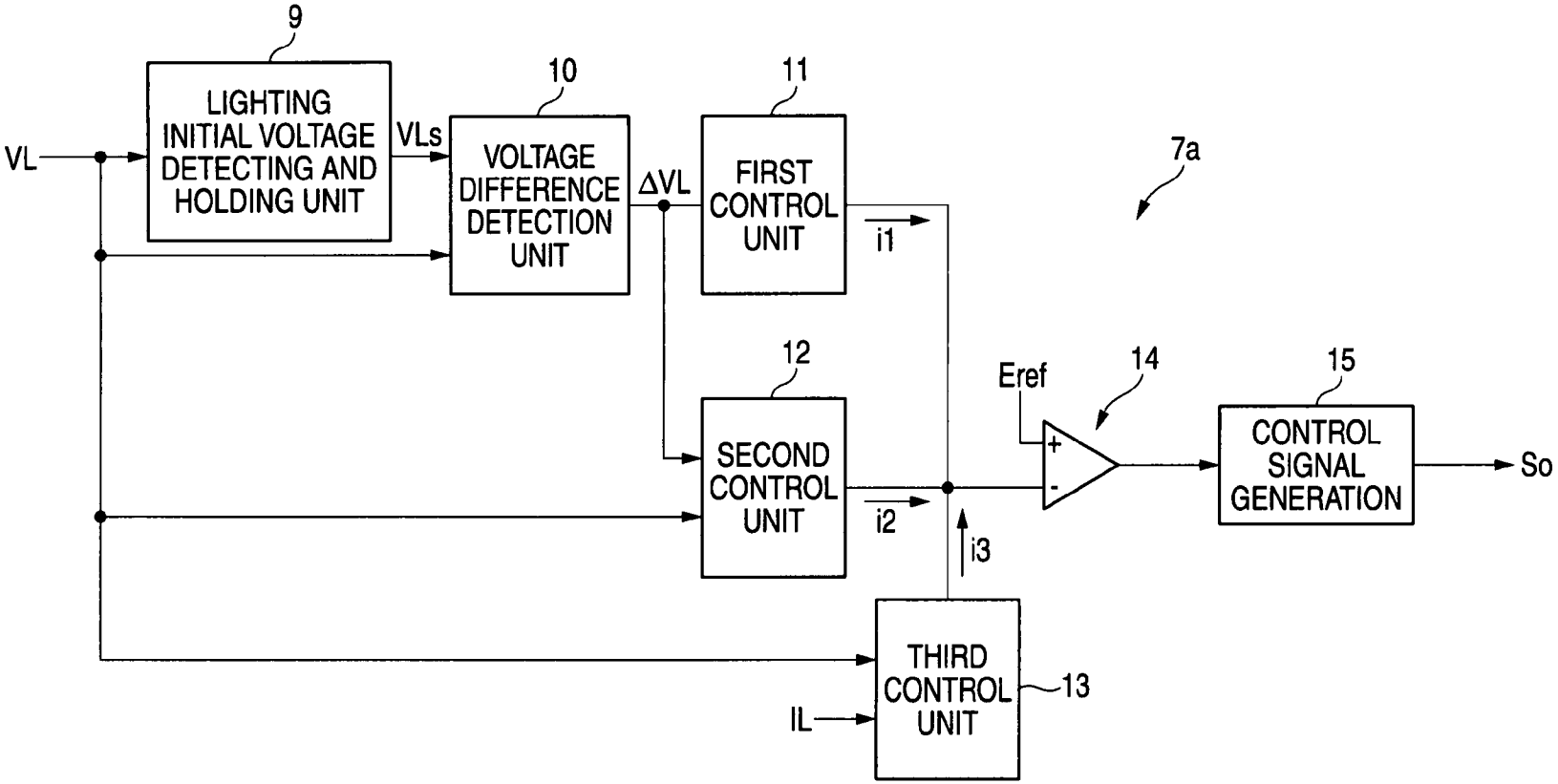
FIG. 2 illustrates a diagram of an exemplary configuration of a power control unit.

FIG. 2 is an exemplary, non-limiting embodiment of the configuration of the power control unit 7*a*. A lighting initial voltage detecting and holding unit 9 and a voltage difference detection unit 10 provided at the succeeding stage constitute a voltage difference detection means which performs the function of detecting a change value of the lamp voltage of the discharge lamp 6 with reference to an initial value thereof.

The lighting initial voltage detecting and holding unit 9 detects the lamp voltage immediately after the turning-on of the discharge lamp 6, and holds the lamp voltage thus detected as the initial value (hereinafter referred to "VLs"). The lighting initial voltage detecting and holding unit outputs the initial value VLs to the voltage difference detection unit 10.

The voltage difference detection unit 10 subtracts VLs from the detection signal VL of the lamp voltage to calculate a change value (hereinafter referred to "ΔVL") of the lamp voltage with reference to VLs and outputs the change value to a first control unit 11 and a second control unit 12.

The first control unit 11 and the second control unit 12 constitute an electric power control means together with a third control unit 13. The output currents (refer to "i1", "i2", "i3" in the figure) from these control units are supplied to an error calculation unit 14 provided at the succeeding stage of these control units 11, 12, 13. The first control unit 11 and the second control unit 12 control transient electric power and the third control unit 13 controls electric power other than the transient electric power.

The first control unit 11 generates the control signal of the output current "i1" in accordance with VLs from the voltage difference detection unit 10. For example but not by way of limitation, the first control unit performs the following control.

i1 is kept to a constant value in the case of $\Delta VL \leqq Sh1$.

i1 is increased with the increase of ΔVL in the case of $Sh1 < \Delta VL < Sh2$.

i1 is kept to be constant in the case where $\Delta VL \geqq Sh2$.

"Sh1" and "Sh2" represent reference values (threshold values) with respect to ΔVL and have a relation of Sh1<Sh2.

The second control unit 12 is applied with ΔVL and VL and performs the electric power control in a manner that, in the transient period until the discharge lamp reaches the steady lighting state, the temporal change rate of the electric power supplied to the discharge lamp is changed in accordance with the increase of ΔVL or the time lapse from a time point where ΔVL increases to a threshold value or more. The output current "i2" of the second control unit increases in accordance with the time lapse from this time point.

In the case of increasing the temporal change rate of the supplied electric power from a negative value to zero by the action of the second control unit 12, there is one mode that controls the temporal change rate continuously, and another mode that controls the temporal change rate stepwise. The latter mode provides ease of the control and the simplification of the circuit configuration, etc. For example but not by way of limitation, when the second control unit 12 is configured to have a time constant circuit using a capacitor and resistors, this second control unit may be arranged in a manner that the time constant circuit is operated when it is detected that ΔVL reaches the threshold value or more, and the temporal change rate of the supplied electric power during the transient time period is changed stepwise by switching the charging time constant of the capacitor thereby to converge into a rated electric power (the concrete circuit configuration will be described later).

The third control unit 13 includes a circuit portion which performs the control at the time of the steady lighting at the rated electric power and the electric power control according to the lamp voltage and the current (VL, IL), etc., whereby the output current i3 of the third control unit is defined (the configuration of the third control unit in the present invention is not limited to a particular structure and any well-known structure may be used; thus, detailed explanation thereof is omitted).

The control signals from the respective control units (the total of the output signals thereof) are applied to the error calculation unit 14. The output signal of the error calculation unit 14 is applied to a control signal generation unit 15, whereby the control signal generation unit generates control signal So. In this embodiment, a reference voltage "Eref" is supplied to one of input terminals (positive input terminal) of an error amplifier constituting the error calculation unit 14, whereby the error calculation unit compares a voltage applied to the other input terminal (negative input terminal) thereof with the reference voltage thereby to output an error signal to the control signal generation unit 15.

The control signal generation unit 15 contains a PWM comparator etc. in the case of the PWM method, for example but not by way of limitation. In this case, the control signal generation unit 15 generates an output signal such that the duty ratio changes in accordance with the error signal from the error calculation unit 14, and the control signal generation unit 15 applies the output signal to the DC-DC conversion circuit 3 (the switching elements therein).

In contrast, in the case of the PFM method, the control signal generation unit 15 generates an output signal of which the frequency changes in accordance with the error signal from the error calculation unit 14, and the control signal generation unit 15 applies the output signal to the DC-DC conversion circuit 3 (i.e., the switching elements therein).

In this exemplary, non-limiting configuration, power control is performed so that the electric power supplied to the discharge lamp reduces in accordance with the increase of the output currents i1 to i3.

Figure 3:
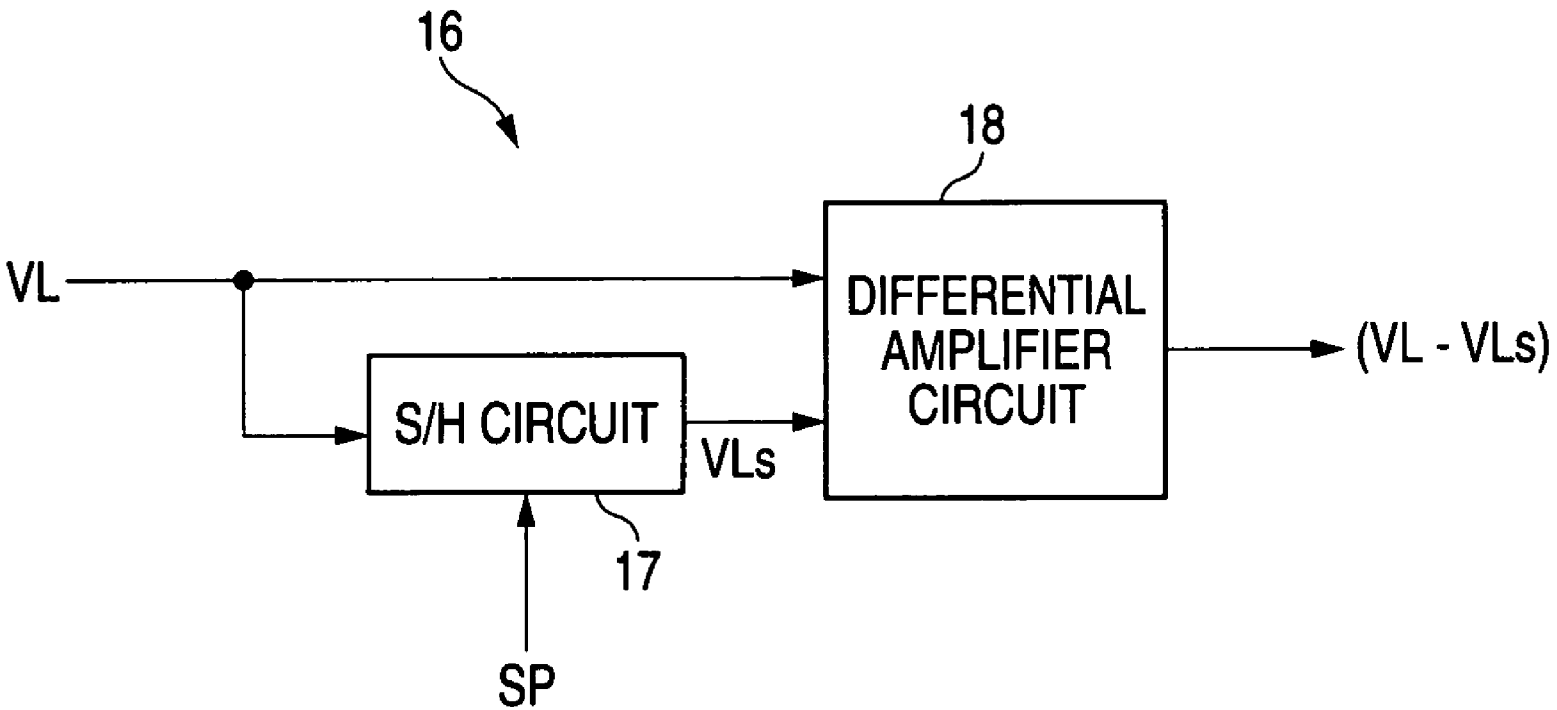
FIG. 3 illustrates a diagram showing an exemplary configuration of a voltage difference detection means according to the invention.

FIG. 3 is an exemplary configuration of the voltage difference detection means 16 for detecting a change value of VL from the initial value VLs, using a sample and hold (S/H) circuit 17 and a differential amplifier circuit 18. For example, but not by way of limitation, this voltage difference detection means 16 may be included as the voltage difference detection unit 10.

The sample and hold circuit 17 receives a timing signal (a sampling signal hereinafter referred to "SP") to hold VL, thereby outputting VLs. For example, the sample and hold circuit 17 is formed by a circuit configuration which includes a switching element transited between on and off positioned in response to the signal SP, a hold capacitor and a voltage buffer. According to this circuit configuration, the switching element is maintained in an on state by the signal SP until a time period passes from the start of the lighting of the discharge lamp to apply the lamp voltage to the hold capacitor, and then the signal SP changes upon the lapse of the time period to turn the switching element off, thereby to hold the lamp voltage (VLs)

The differential amplifier circuit 18 is arranged to obtain an output, that is, ΔVL proportional to (VL−VLs) which is the result of the subtraction of VLs from VL. For example, a circuit known in the art that uses an operation amplifier may be used as the differential amplifier circuit.

Although, in this exemplary, non-limiting embodiment, the sample and hold circuit 17 is used as a means for holding VLs, the present invention is not limited thereto. For example but not by way of limitation, a bottom hold circuit for VL may be used instead of the sample and hold circuit (that is, since the VL value exhibits the minimum value immediately after the start of the lighting of the discharge lamp, VLs can be obtained by detecting and holding the minimum value).

Next, the circuit configuration and operation of the second control unit 12 will be explained with reference to FIGS. 4 to 7.

For example but not by way of limitation, the following modes are considered as the configuration of the second control unit including the time constant circuit having a capacitor and resistors.

(I) A mode in which the temporal change rate of the electric power supplied to the discharge lamp is changed in accordance with the increase of the terminal voltage of the capacitor while comparing the terminal voltage with a reference value.

(II) A mode in which the temporal change rate of the electric power supplied to the discharge lamp is changed in accordance with the increase of the change value ΔVL of the lamp voltage while comparing the change value with a reference value.

According to the mode (I), it is possible to make constant a time period from the start of the charging of a capacitor for controlling a timer, to a time point for switching the time constant, whereby it is possible to suppress the supplied electric power to a suitable value during the period where noise is likely to be generated (noise can be suppressed to be held at a minimum degree).

According to the mode (II), the state of the lamp can be reflected on the switching control of the time constant, whereby it is possible to substantially reduce an amount of overshoot at the time of raising the light intensity.

Figure 4:
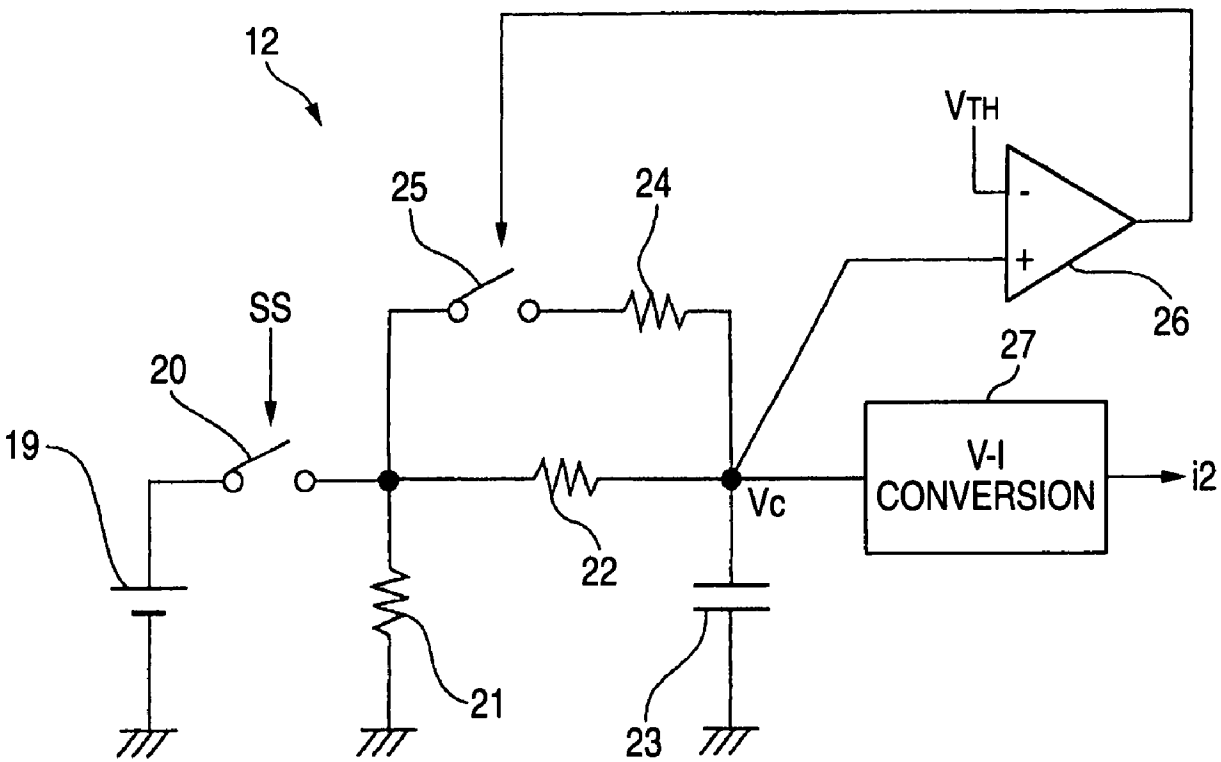
FIG. 4 illustrates a diagram showing the basic configuration of a second control unit.

FIG. 4 shows an example of the basic configuration of the second control unit 12 in the mode (I), which shows a mode for switching the time constant between two values.

A voltage from a power supply 19 is applied to the one end of a resistor 21 through a switching element 20 (this element is illustrated in a simplified manner by a symbol of a switch in). The switching element 20 is controlled so as to be transmitted between on and off positions in response to a control signal SS in a manner that the switching element is placed on an off state until ΔVL reaches a value (hereinafter referred to "ΔVL2") and placed in an on state when ΔVL becomes equal to ΔVL2.

One end of the resistor 21 is coupled to a capacitor 23 through a resistor 22, and the other end of the resistor 21 is grounded.

A switching element 25 (this element is illustrated in a simplified manner by a symbol of a switch) is coupled to a resistor 24 coupled in parallel to the resistor 22. In other words, one end of the resistor 24 is coupled to the capacitor 23 and the other end of the resistor 24 is coupled to a connection point between the resistors 21 and 22 through the switching element 25.

The capacitor 23 is coupled at its one end to the input terminal of a comparison circuit 26 and the input terminal of a V-I conversion unit 27, and is coupled at its the other end to the ground.

The comparison circuit 26 compares the terminal voltage (hereinafter referred to "Vc") of the capacitor 23 with a reference voltage (hereinafter referred to "$V_{TH}$") The comparison circuit outputs a binary signal in accordance with the comparison result and applies the binary signal to the switching element 25 as a control signal. Accordingly, the switching element is controlled in its on and off states in a manner that the switching element 25 is placed in an off state in the case of $Vc \leqq V_{TH}$ and placed in an on state in the case of $Vc > V_{TH}$.

The V-I conversion unit 27 converts the input voltage (Vc) into a current in proportional to the input voltage to obtain the output current (the aforesaid current i2) according to Vc and outputs the current.

In this manner, this mode is arranged so that in the time constant circuit having the capacitor 23 and the resistors 21, 22, 24, the switching element 20 is placed in an on state when the comparator circuit 26 detects that ΔVL is equal to ΔVL2, whereby the charging operation of the capacitor 23 is started. Thus, Vc increases at a first time constant (hereinafter referred to "τ1") determined by the static capacitor of the capacitor 23 and the resistance values of the two resistors, whilst the electric power applied to the discharge lamp during the transient time period is controlled (reduced) in a reverse phase relation with the change of Vc. Thereafter, when Vc further increases and reaches a value satisfying a relation of $Vc > V_{TH}$, the switching element 25 is placed in an on state. Thus, since a charging path to the capacitor 23 increases to two paths, the time constant is switched into a second time constant (hereinafter referred to "τ2") which is smaller than the first time constant. As a result, the increasing rate of Vc becomes large and so the reducing speed (an absolute value the temporal change rate) of the supplied electric power during the transient time period becomes large.

In the off state of the switching element 20, a discharge path of the capacitor 23 through the resistor 21 is formed.

Figure 5:
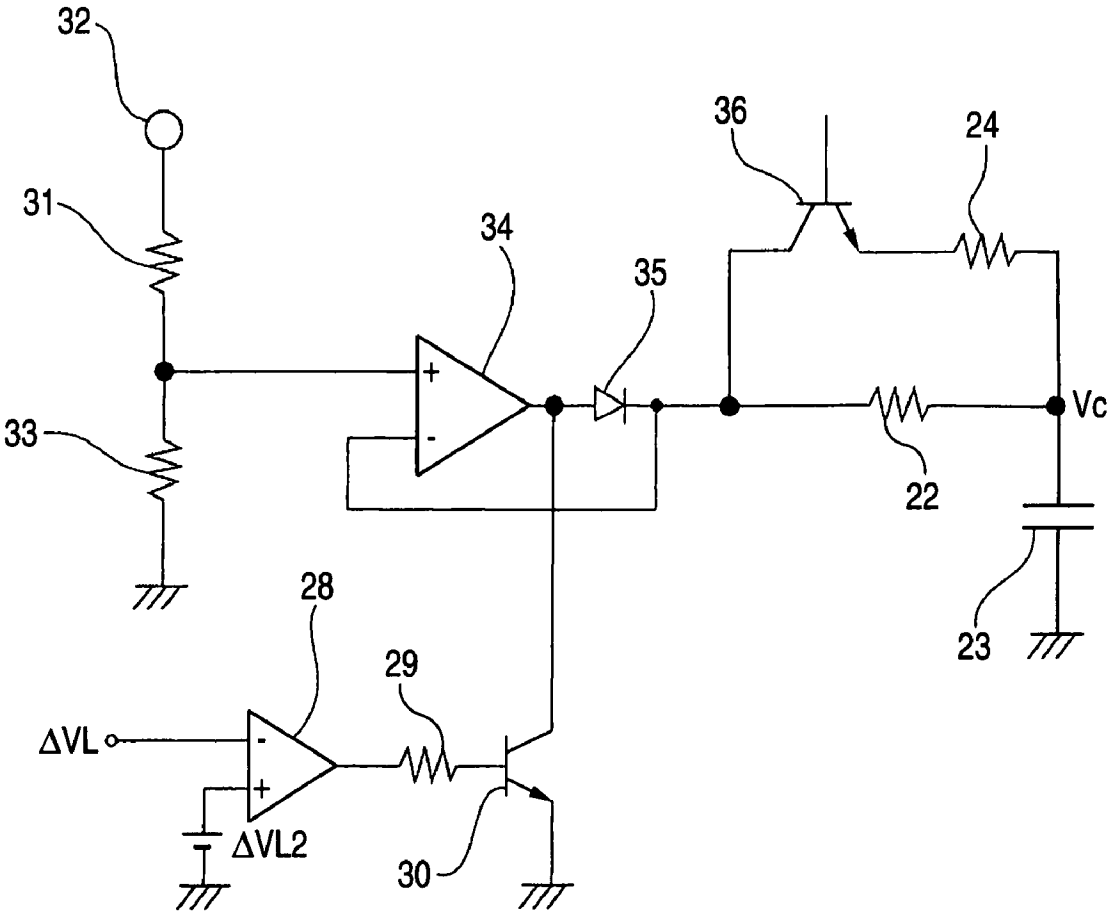
FIG. 5 illustrates a diagram showing the main portion of the exemplary circuit configuration of the second control unit.

FIG. 5 shows only the main portion of the exemplary circuit configuration of the second control unit 12. The comparator 28 receives ΔVL at its negative input terminal and also receives a reference voltage corresponding to ΔVL2 at its positive input terminal. The comparator 28 supplies an output signal to the base of an NPN transistor 30 of common emitter type through a resistor 29.

A resistor 31 is connected at one end to a power supply terminal 32 having a voltage and grounded at its the other end through a resistor 33. Thus, this resistor serves as a voltage dividing resistor together with the resistor 33.

An operational amplifier 34 is coupled at its non-inverting input terminal to a connection point between the resistors 31 and 33 and coupled at its inverting input terminal to a diode 35 at the succeeding stage of the operational amplifier 34. In other words, the output terminal of the operational amplifier 34 is coupled to the anode of the diode 35, whilst the cathode of the diode 35 is coupled to the inverting input terminal of the operational amplifier 34, the resistor 22 and an NPN transistor 36.

The collector of the NPN transistor 30 is coupled to the output terminal of the operational amplifier 34. Thus, when $\Delta VL \leqq \Delta VL2$, the NPN transistor 30 is turned on in response to the output signal from the comparator 28, whereby the output terminal of the operational amplifier 34 is almost grounded and so the capacitor 23 is not charged. In the case of $\Delta VL \geqq \Delta VL2$, the NPN transistor 30 is turned off in response to the output signal from the comparator 28, whereby the operational amplifier 34 acts as a buffer circuit and a voltage divided by the resistors 31 and 33 is applied to the capacitor 23 through the resistor 22 (thus, Vc increases with the time constant $\tau 1$ due to the start of the charging operation).

In FIG. 5, the NPN transistor 36 coupled to the resistor 24 corresponds to the switching element 25 and the base of the NPN transistor 36 is supplied with the control signal according to the comparison result between Vc and $V_{TH}$.

Figure 6:
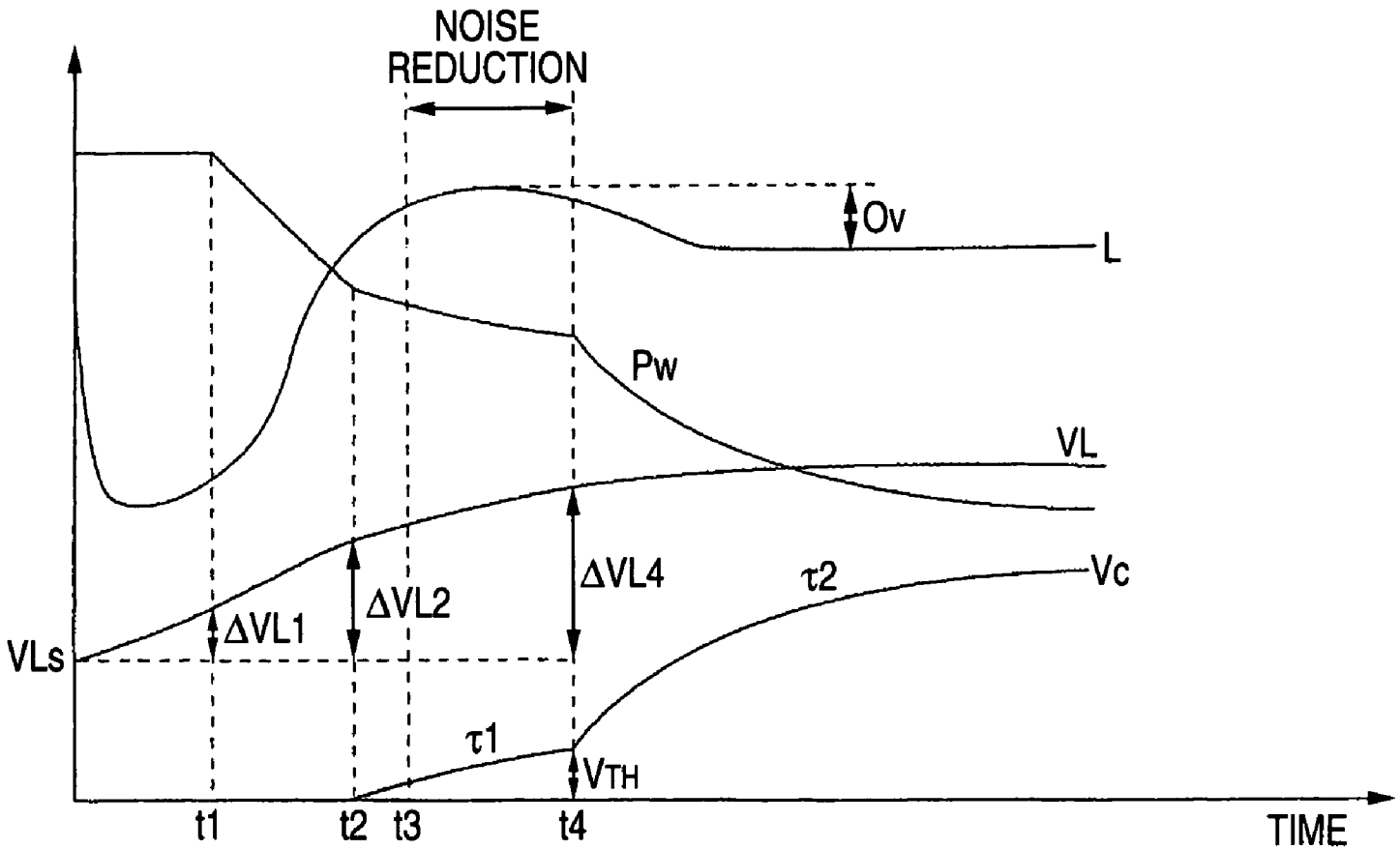
FIG. 6 illustrates a diagram showing a graph for explaining the control at the time of the cold start of the discharge lamp.

FIG. 6 is a diagram exemplarily showing the temporal changes of the optical output "L", the supplied electric power "Pw", the lamp voltage "VL" and the terminal voltage "Vc" of the capacitor 23. The meanings of the time points t1, t2, t3, t4 etc. in the figure are already explained above.

The capacitor 23 starts to be charged at the time point t2 when ΔVL reaches ΔVL2. The charging time constant ($\tau 1$) at this time point is set to a large value, whereby the reducing speed of the electric power supplied to the discharge lamp is suppressed and so more electric power can be supplied to the discharge lamp (during a time period between t3 and t4). In other words, when more electric power is supplied to the discharge lamp during this period, the discharge lamp can quickly pass the unstable state where the radio noise is likely generated, so that the escape from the unstable state can be quickly realized (the noise suppression effect can be exerted sufficiently).

Thereafter, Vc becomes larger than $V_{TH}$ at time point t4, whereby the charge time constant is switched into $\tau 2$. Thus, since the charging speed of the capacitor 23 is increased, the supplied electric power can be reduced to a large extent as compared with the past to converge the supplied electric power to the level of the steady control.

As a result, an amount "Ov" of the overshoot in the rising characteristics of the optical output can be substantially suppressed, and also the radiation noise from the luminous tube can be substantially reduced during the period between t3 and t4.

Figure 7:
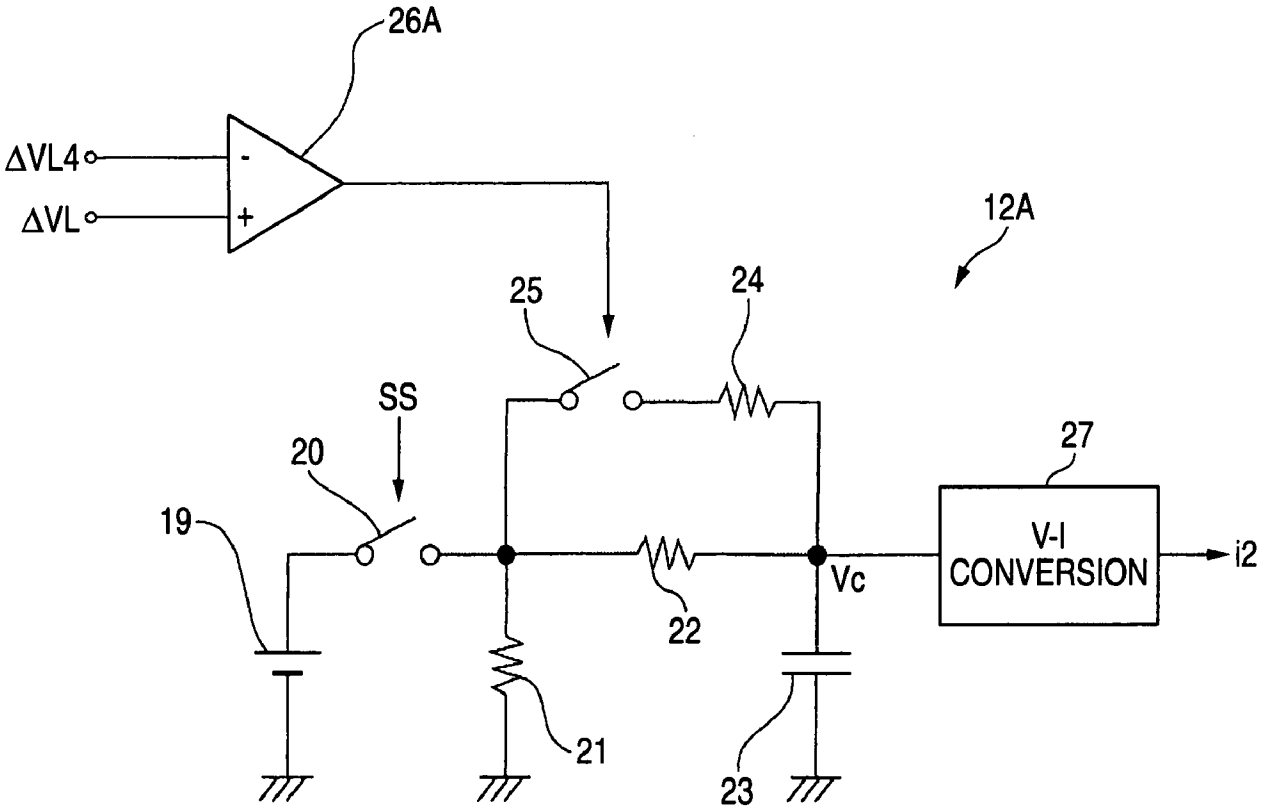
FIG. 7 illustrates a diagram showing the basic configuration of another mode of the second control unit.
Figure 8:
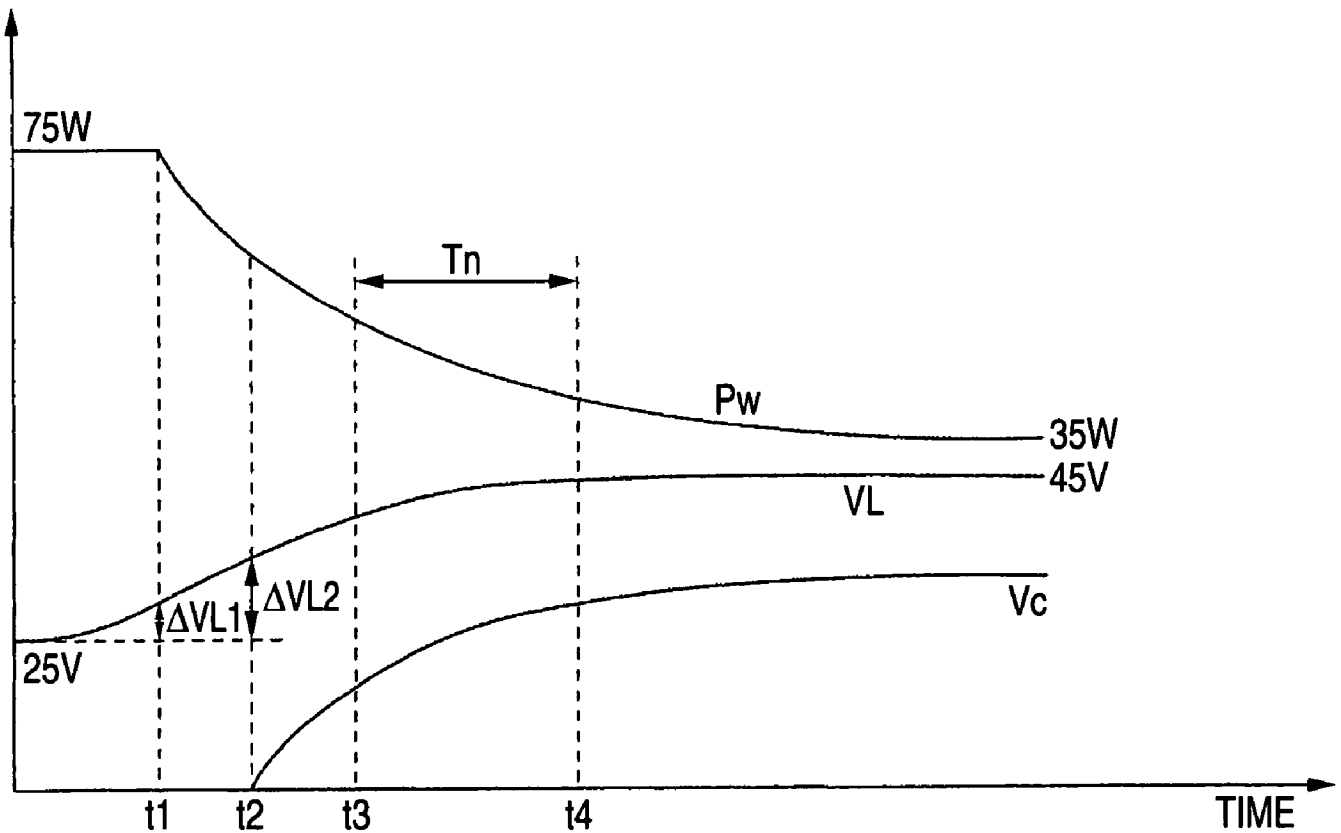
FIG. 8 illustrates a diagram showing a graph of the control at the time of the cold start of the discharge lamp in the related art.
Figure 9:
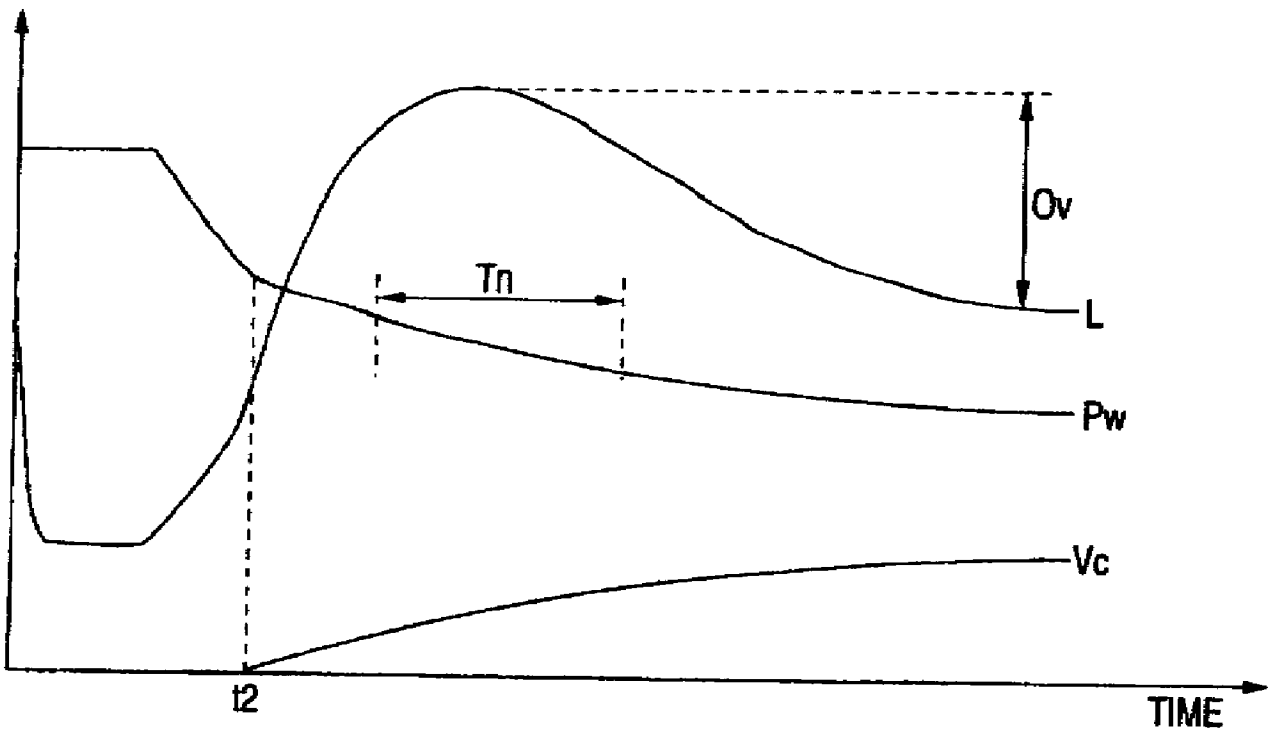
FIG. 9 PRIOR ART
FIG. 9 illustrates a diagram showing a related art problem.

Next, an example of the basic configuration of the second control unit according to the second mode will be explained with reference to FIG. 7. A second control unit 12A shows a mode in which the time constant is switched between two values in accordance with the increase of ΔVL.

The voltage from the power supply 19 shown by a symbol of a constant voltage supply is supplied to the one end of a resistor 21 through a switching element 20 (this element is illustrated in a simplified manner by a symbol of a switch). The switching element 20 is transited between on and off positions in response to a control signal marked by "SS" in the figure such that the switching element is placed on an off state until ΔVL reaches ΔVL2 and placed in an on state when ΔVL becomes equal to ΔVL2.

The one end of the resistor 21 is coupled to a capacitor 23 through the resistor 22 and the other end of the resistor 21 is grounded.

A switching element 25 (this element is illustrated in a simplified manner by a symbol of a switch) is coupled to a resistor 24 coupled in parallel to the resistor 22. In other words, the one end of the resistor 24 is coupled to the capacitor 23 and the other end of the resistor 24 is coupled to a connection point between the resistors 21 and 22 through the switching element 25.

A comparison circuit 26A compares ΔVL with a value (hereinafter referred to "ΔVL4") to define the on or off state of the switching element 25 in accordance with the comparison result. That is, the switching element 25 is placed in an off state during a time period until ΔVL reaches ΔVL4 and placed in an on state when ΔVL reaches ΔVL4.

The terminal voltage Vc of the capacitor 23 is applied to a V-I conversion unit 27 which converts the input terminal voltage into a current proportional to the input voltage so as to obtain the output current (the aforesaid current i2).

In this mode, in FIG. 6, the charging operation of the capacitor 23 is started at the time point t2 where ΔVL reaches ΔVL2. The charge time constant in this case is $\tau 1$. Thus, the reducing speed of the electric power supplied to the discharge lamp is suppressed and so more electric power can be supplied to the discharge lamp (during a time period between t3 and t4).

Thereafter, ΔVL reaches ΔVL4 at the time point t4, whereby the switching element 25 is turned on by the comparator 26A and so the charge time constant is switched into $\tau 2$.

In this manner, the time constant is switched while monitoring the change amount relating to the lamp voltage, whereby the supplied electric power can be controlled.

Although each of the circuit configurations described above is arranged in a manner that the temporal change rate of the supplied electric power is changed by switching the time constant in the two stages, the time constant may be switched in three or more stages according to need. However, in this case, it is necessary to consider the noise suppression effects and the effects of suppressing the overshoot of the optical output change, which can be obtained sufficiently during the time period of the first time constant $\tau 1$ (including the time period between t3 and t4), and also required not to complicate the circuit configuration in accordance with the switching of the time constants.

According to the configuration described above, the terminal voltage of the capacitor (23) for controlling the timer and the change value ΔVL relating to the lamp voltage are monitored. During the time period where there arises a problem that noise is generated, the electric power is controlled such that the reducing speed of the supplied electric power is reduced by paying attention to the overshoot of the light intensity. Then, the charge time constant is switched from the time point where the time period has passed, whereby the reducing speed of the supplied electric power can be increased.

It will be apparent to those skilled in the art that various modifications and variations can be made to the described preferred embodiments of the present invention without departing from the spirit or scope of the invention. Thus, it is intended that the present invention cover all modifications and variations of this invention consistent with the scope of the appended claims and their equivalents.

The invention claimed is:

1. An apparatus for a discharge lamp containing no mercury or a small amount of mercury, which gradually reduces electric power supplied to the discharge lamp in accordance with a time lapse during a transient time period, where the discharge lamp reaches a stable lighting state, comprising:

means for detecting a change value of a lamp voltage from an initial lamp voltage value; and means for controlling electric power which switches in a stepwise manner, when the change value reaches at least a threshold value, a temporal change rate of electric power supplied to the discharge lamp during the transient time period in accordance with one of an increase of the change value and a time lapse;

wherein the means for controlling includes a time constant circuit comprising a capacitor and a plurality of resistors, the time constant circuit operating when the change value relating to the lamp voltage reaches at least the threshold value, and a charge time constant of the capacitor is switched in accordance with one of an increase of the change value and an increase of a voltage of the capacitor to control the temporal change rate of the electric power during the transient time period in the stepwise manner, and wherein, the electric power during the transient time period is controlled in accordance with a first time constant when the change value relating to the lamp voltage reaches at least the threshold value, and the electric power during the transient time period is controlled in accordance with a second time constant smaller than the first time constant.

2. The apparatus for a discharge lamp according to claim 1, wherein the temporal change rate of electric power supplied to the discharge lamp during the transient time period in accordance with the increase of the change value.

3. A discharge lamp apparatus comprising:

a first converter circuit that converts an input voltage into a desired voltage in accordance with a control signal generated by a power control unit based on at least one of a voltage of a lamp and a current of said lamp;

a second converter circuit that converts said desired voltage into lamp supply voltage in accordance with a drive control unit, and provides said lamp supply voltage to said lamp; and a starter circuit coupled between said second converter circuit and said lamp, said starter circuit generating a starting pulse to start said lamp, wherein said lamp has a substantially low mercury level, wherein said power control unit performs said control by one of pulse width modulation and pulse frequency modulation, wherein said first converter circuit converts a DC input voltage into a desired DC voltage, and said second converter circuit converts said desired DC voltage into an AC voltage; and wherein said power control unit includes a time constant circuit comprising a capacitor and a resistor, the time constant circuit operating when a difference between the lamp voltage and a reference voltage reaches at least a threshold value, and a charge time constant of the capacitor is switched in accordance with one of an increase of said difference and an increase of a voltage of the capacitor to control a temporal change rate of the electric power during a transient time period in a stepwise manner, wherein said power control circuit comprises:

a voltage change detecting unit that detects a difference between a reference voltage and said lamp voltage, and outputs said difference;

an electric power controller that receives said difference, said lamp voltage and said lamp current, and generates said control signal wherein said electric power controller comprises:

a first control unit that generates a first output current that is substantially constant when said difference is within a predetermined voltage range of reference values;

a second control unit that generates a second output current that increases temporally until said lamp reaches a stable lighting state, wherein said temporal increase is based on one of an increase in said difference and a time lapse, wherein said temporal increase is one of continuous and stepwise; and a third control unit that generates a third output to control said lamp voltage and said lamp current during said stable lighting state, wherein said first control unit and said second control unit control said lamp voltage and said lamp current until said lamp reaches said stable lighting state.

4. The discharge lamp apparatus of claim 3, wherein said voltage and said current of said lamp are determined based on an output voltage and an output current of said first converter circuit.

5. The discharge lamp apparatus of claim 3, wherein said lamp has substantially no mercury.

6. The discharge lamp apparatus of claim 3, wherein said first, second and third outputs of said electric power controller are processed by an error calculation unit that generates an error signal, and a control signal generator processes said error signal to generate said control signal.

7. The discharge lamp apparatus of claim 3, wherein said second control unit comprises:

a comparator that determines whether said difference exceeds a reference difference and generates a comparator output;

a first switching device that is transited to its on position when said comparator output is indicative of a reference difference greater than said difference; and an operational amplifier that provides a current to a capacitive device when said first switching device is not in its on position, so as to increase said second output current in accordance with a terminal voltage of said capacitive device during a first time period to substantially suppress noise, and to increase said second output current in accordance with a change in said difference during a second time period to substantially minimize overshoot during lamp startup.

8. The discharge lamp apparatus of claim 3, wherein the charge time constant of the capacitor is switched in accordance with the increase of said difference.

9. A discharge lamp apparatus comprising:

a first converter circuit that converts an input voltage into a desired voltage in accordance with a control signal generated by a power control unit based on at least one of a voltage of a lamp and a current of said lamp;

a second converter circuit that converts said desired voltage into lamp supply voltage in accordance with a drive control unit, and provides said lamp supply voltage to said lamp; and a starter circuit coupled between said second converter circuit and said lamp, said starter circuit generating a starting pulse to start said lamp, wherein said lamp has a substantially low mercury level, wherein said power control unit performs said control by one of pulse width modulation and pulse frequency modulation, wherein said first converter circuit converts a DC input voltage into a desired DC voltage, and said second converter circuit converts said desired DC voltage into an AC voltage; and wherein said power control unit includes a time constant circuit comprising a capacitor and a plurality of resistors, the time constant circuit operating when a difference between the lamp voltage and a reference voltage reaches at least a threshold value, and a charge time constant of the capacitor is switched in accordance with one of an increase of said difference and an increase of a voltage of the capacitor to control a temporal change rate of the electric power during a transient time period in a stepwise manner;

wherein, the electric power during the transient time period is controlled in accordance with a first time constant when the change value relating to the lamp voltage reaches at least the threshold value, and the electric power during the transient time period is controlled in accordance with a second time constant smaller than the first time constant.

* * * * *